United States Patent [19]

Völker

[11] 3,937,350

[45] Feb. 10, 1976

[54] STOPPER FOR BOTTLES

[76] Inventor: Hans Völker, Wolfsgrubengasse 2/c, 854 Schwabach, Germany

[22] Filed: Mar. 27, 1975

[21] Appl. No.: 562,564

[30] Foreign Application Priority Data

Mar. 27, 1974 Germany ..... 2414667

[52] U.S. Cl. ..... 215/361

[51] Int. Cl.[2] ..... B65D 39/12

[58] Field of Search ..... 215/361, 359; 220/234

[56] References Cited

UNITED STATES PATENTS

| | | | |
|---|---|---|---|
| 2,021,259 | 11/1935 | Magnuson | 215/361 |
| 2,822,103 | 2/1958 | Moller | 215/359 |

*Primary Examiner*—George T. Hall

*Attorney, Agent, or Firm*—Walter Becker

[57] ABSTRACT

A stopper for bottles, especially for closing uncorked wine and champagne bottles which comprises an elastic deformable sleeve member to be inserted into the bottle neck to be closed, which sleeve member has a mantle section and a closed bottom section and an open top section through which extends a connecting rod rigidly connected to a cap or hood which in inserted position of the stopper surrounds the upper neck portion of the bottle to be closed. The cap or hood forms a handle which is adapted to force the sleeve member into the bottle neck to be closed by stretching the sleeve member. The outer diameter of the piston is slightly less than the inner diameter of the bottle neck portion to be closed by the stopper, and the wall thickness of the sleeve mantle section in non-deformed condition of the sleeve member is greater than the thickness of the annular gap between the outer periphery of the piston and the bottle neck section of the bottle to be closed by the stopper.

15 Claims, 4 Drawing Figures

STOPPER FOR BOTTLES

The present invention relates to a stopper for bottles, especially for closing uncorked wine and champagne bottles, with an elastic sleeve part which is closed at its bottom and open at its top and is provided with an outer and an inner flange while said sleeve part has associated therewith a handle coaxially arranged with said sleeve part. The said handle comprises a cap or hood and has an inner part which is rigidly connected to said hood and is provided with a piston longitudinally displaceable within said sleeve part, said closure being adapted by the longitudinal displacement of said inner part to permit the mantle of said sleeve part to stretch to thereby reduce its outer diameter.

It is an object of the present invention to provide a stopper which will permit by a slight manual effort, again closing the respective bottle by the stopper safely and tightly, and in particular any uncorked wine or champagne bottle provided with a stopper according to the invention. It is also an object of this invention to obtain such safe and tight closure even with effervescent wine in the respective bottle or with the bottle containing champagne having an inner overpressure.

It is still another object of this invention so to design the stopper that the stopper will be able when pulling the said handle with approximately the same slight manual effort necessary for opening the bottle, to again remove the stopper from the bottle.

It is a further object of this invention so to design a stopper as set forth in the preceding paragraphs that the advantages outlined above in connection with the present invention will be retained in any practically occurring relatively wide temperature range. Thus, storing the bottle with the stopper according to the invention at a lower temperature for instance in a refrigerator, should not interfere with the easy opening of the bottle. Furthermore, it is an object of the invention so to design the stopper outlined above that it will have a long, useful life, can easily be taken apart and can easily be cleaned and will have a minimum of parts while it can be produced at a low price.

These and other objects and advantages of the invention will appear more clearly from the following specification in connection with the accompanying drawing, in which.

Figure 1:
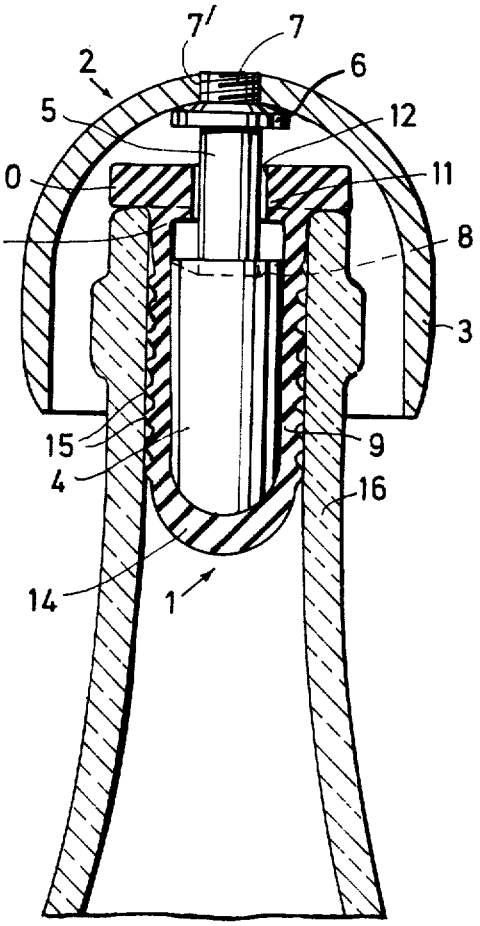
FIG. 1 illustrates a longitudinal section, partially on an enlarged scale, of a closure according to the invention and shows the upper part of a wine bottle.
Figure 2:
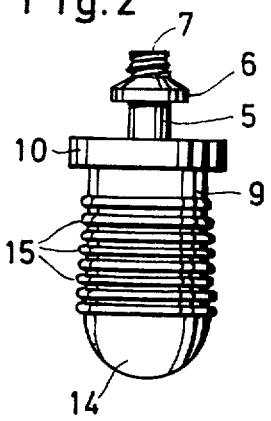
FIG. 2 is a side view of a stopper according to the invention while the hood is omitted.

The stopper according to the present invention is characterized primarily in that the inner part of the handle part has its lower end provided with a rigid axially stretchable cylindrical piston, the diameter of which is only slightly less than the inner diameter of the bottle neck to be closed while the wall thickness of the sleeve mantle in non-distorted condition of the sleeve part is greater than the thickness of the annular gap between the bottle neck and the piston and while the sleeve part is made of an elastically well deformable material so that it is possible in response to the application of a relatively low force to cause the wall thickness of the sleeve mantle to become equal or less than the thickness of the annular gap between the piston and the bottle neck, and it is further possible to press in the closure part easily into the bottle neck to be closed and to pull it out therefrom.

The present invention makes use of the property of a body of elastic material which is well deformable, for instance of soft rubber, and which in combination with a strong stretching simultaneously is subjected to a considerable decrease in cross section. This brings about that the thickness of the sleeve mantle can already when applying a slight pulling force be reduced by 50 percent or more of its original thickness. As a result thereof, it is possible to use the same stopper for a standarized bottle, the opening diameter of which deviates from the fixed standard in both directions by approximately ± 5 percent. This standard amounts to for instance 18mm with wine and champagne bottles. The tolerance ascertained during the manufacture of the stopper amounts to a maximum of ± 1mm. By suitably dimensioning the closure stopper especially by suitably dimensioning the wall thickness of the sleeve part, it is possible to introduce the same stopper in the lower tolerance region of the bottle opening, i.e., 17mm, equally well to remove the stopper from the bottle, in the upper tolerance range of the bottle opening, i.e., 19mm, still to obtain a good seal also at an inner overpressure of the bottle.

The stopper according to the invention, therefore, is to a high degree useful for closing standarized bottles, especially wine and champagne bottles, the content of which following the uncorking is to be held closed for a certain time and if desired is to be stored for later use in a refrigerator.

For closing uncorked wine and champagne bottles, stoppers have become known which have an elastic sleeve part adapted to be introduced into the bottle opening, and also have a handle for handling the closure, and furthermore have a piston which is longitudinally displaceable in the sleeve part. By means of the piston, the mantle of the sleeve part can be stretched and its outer diameter can be reduced so that the sleeve part can be introduced into the bottle opening and be removed therefrom. In contrast to the present invention, it is necessary with a heretofore known design of the just mentioned part to turn the handle relative to the sleeve part, and with another heretofore known design of the above mentioned general type it is possible by means of a separate pressure plate provided on the handle part to move the piston longitudinally displaceable in the sleeve part in downward direction and to stretch the sleeve part in toto to such an extent that the stopper can be pulled out of the bottle opening. Such a design of the stopper, however, aside from its complicated structure and its unreliable action requires an awkward handling. In contrast thereto, the closure according to the invention can after being introduced into the bottle opening easily and with only a very slight effort be pulled out of the bottle opening by a simple pulling at the hood of the handle part.

According to an important feature of the invention, the sleeve part consists of a material which even at low temperatures as they prevail, for instance in a refrigerator, is still tough elastic. As particularly advantageous for the material of the sleeve part has proved a tough elastic soft rubber.

According to a further important feature of the invention, the inner and outer flange and the bottom of the sleeve part has a greater wall thickness than the sleeve mantle. This greater wall thickness may amount to a multiple of the wall thickness of the sleeve mantle. This has the advantage that when introducing the stopper and also when removing the same from the bottle opening, said sleeve parts can in comparison to the mantle deform only slightly whereby during a relative movement between a handle part and the sleeve part practically only the sleeve mantle is expanded and its thickness is thereby reduced. Expediently, outer and inner flanges have their upper side located flush in one plane. The inner flange may project upon the outer flange in downward direction.

The handle part with its hood and its substantially longitudinally extending cylindrical piston and a shank may be formed out of one piece such as wood, synthetic material or metal, especially light metal. Hood and inner part may also consist of two separate individually made parts which, depending on the type of material, may be rigidly connected to each other by gluing, welding, riveting or a screw connection. Expediently, the hood has a form of a suitable not too small size which is comfortably grasped by the hand. Advantageously the hood may consist of a spherical bowl or a partial hollow ball which covers the upper portion of the bottle neck and with its lower part or end extends closely to the bottle neck.

Referring now to the drawing in detail, the stopper consists only of two parts movable relative to each other, the form-elastic sleeve part 1, and the handle part 2 of a stiff material. As tests have shown, a tough elastic soft rubber which also remains nearly unchangeably elastic at relatively low temperatures has proved particularly good for making the sleeve part 1.

The handle part 2, in the specific instance shown, is composed of two parts of aluminum, namely a bowl shaped or ball shaped hood 3 and an inner part screwed from the inside into said hood. The inner part forms a one-piece longitudinally extending cylindrical piston 4, which is semi-spherically rounded at the lower end. The inner part furthermore comprises a cylindrical shank 5 the uppere end of which has a smaller cross section than that of piston 4, and furthermore comprises flange 6 which limits said shank 5 at its upper end. Finally the inner part comprises a short threaded stub 7 which is adjacent the flange 6 and extends in upward direction. The threaded stub 7 is screwed into a corresponding central threaded core 7' of said hood 3. The spherical hood 3 surrounds the upper portion of the bottle neck 16 completely and extends downwardly up to far below the bottle opening.

The upper end face 8 of the piston 4 is downwardly conically depressed whereby the adhering capability between handle part 2 and sleeve part 1 when pulling the stopper out of the bottle is improved. The lower confinement or limit of the inner flange 11 may likewise correspondingly be designed so as to extend conically downwardly.

The sleeve part 1 has its dimensions adapted to meet the respective problem at an optimum. The sleeve part 1 primarily consists of a cylindrical mantle 9 of uniformly relatively thin wall thickness which mantle at its upper portion merges with a cylindrical outer flange 10 and a likewise cylindrical inner flange 11. The diameter of the outer flange 10 is expediently equal to the mean outer diameter of the neck of a certain bottle type, especially wine or champagne bottle. The thickness of said outer flange 10 is substantially greater than the wall thickness of the sleeve mantle 9 and in the specific illustrated case amounts to about twice the thickness of the sleeve mantle 9. The inner flange 11 is confined by a central cylindrical opening 12, the clear width of which approximately equals half the diameter of the piston 4 or approximately equals the diameter of the shank 5. Outer and inner flanges 10, 11 have a plane confinement. The inner flange 11 is in the illustrated instance still thicker than flange 10. It thickness amounts to about three times the wall thickness of the sleeve mantle 9.

Figure 3:
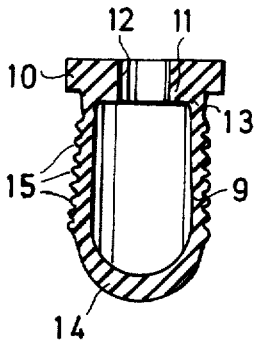
FIG. 3 shows the sleeve part of the stopper alone, and more specifically a longitudinal section therethrough.
Figure 4:
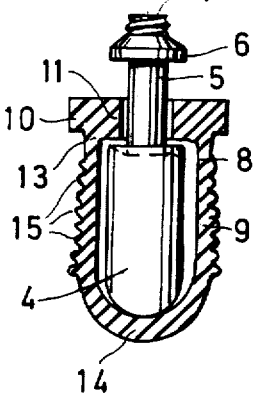
FIG. 4 shows a longitudinal section through the sleeve part of the stopper with inserted inner part illustrated in side view.

As will be evident from FIGS. 1, 3 and 4, outer and inner flanges 10, 11 merge at 13 with a small radius of curvature with the sleeve mantle 9. The bottom side of the inner flange 11 ends in the illustrated instance inwardly and horizontally.

The mantle 9 is at its lower end closed by a downwardly arched bottom 14, the wall thickness of which amounts in the central portion approximately to twice the wall thickness of the mantle 9. This bottom 14 merges with a continuous reduction in cross section with the cylindrical mantle 9.

The surface of the flange portions 10, 11, of the bottom 14, and the inner surface of the mantle 9 are smooth and burr free. Merely on the outer side of the mantle 9 at a slight distance between each other there is provided a plurality of fins or ribs 15 with an outer confinement arched in cross section in a semi-spherical manner. The height of said ribs or fins is in the specific illustrated instance selected to amount to approximately 50 percent of the wall thickness of the mantle 9.

The usefulness of the invention will stilll further become apparent from the following remarks. The examination of a great number of different wine and champagne bottles has shown that their opening diameter at the upper rim is within the limits of from 17–19mm, and this diameter differs from case to case and increases in downward direction more or less. With a selected diameter of the cylindrical piston 4 of 12mm, their results for the annular gap between bottle neck and piston a thickness of from 2.5–3.5mm which slightly increases in downward direction. Therefore, it is sufficient to design the thickness of the mantle part consisting primarily of the cylinder mantle 9 and the ribs 15 so that the thickness of said mantle part amounts to about from 3.5–4.5mm. This dimension is with non-deformed sleeve part 1 or non-deformed mantle part 9,15 greater than the thickness of the annular gap between the bottle neck and piston 4. On the other hand, with a suitable selection of material for the sleeve part 1, for instance soft rubber, it is possible without great efforts to pull the mantle part 9, 15 to such a length that its thickness drops below the amount of 3.5 or 2.5mm. As a result thereof, the stopper can be introduced into the bottle opening by pressing the same into said bottle opening and by pulling the stopper out can again without great effort be removed from the bottle.

For the length of the mantle part 9,15 and the length of the piston 4, a valve of from 25–30mm has been found suitable, and for the length of the shank 5, a length of from 15–20mm has been found sufficient.

The introduction of the closure stopper into the bottle opening is effected by simply pressing the lower arched bottom 14 upon the bottle opening and by pressing said bottom into the bottle. In this connection, at the upper rim of the bottle opening a small accumulation of the mantle part 9,15 occurs and therebelow a considerable expansion of the mantle part 9,15 so that when exceeding a certain pressure upon the hood 3, the mantle part 9,15 slides into the bottle opening. The mantle part 9,15 of the stopper which during the insertion of the stopper is stretched more or less will, when the pressing-in pressure decreases, contract again at its lower part while its inner side engages the piston 4 at the outside thereof with its ribs 15 so as to be close to the bottle neck 16. The outer confinement of the ribs 15 flattens somewhat. The ribs 15 together with the closed annular spaces provided therebetween form a type of labyrinth seal. In this connection, the mantle part 9, 15 will, depending on the inner diameter of the bottle neck, be subjected to a more or less remaining stretching. Due to its characteristic, especially the relatively thick sleeve bottom 14, the closure stopper according to the invention also withstands a considerable inner overpressure in the bottle. The removing of said inner pressure from the bottle may likewise be carried out without any material effort by a simple pulling out operation. The inner face 8 of the piston 4 will at the inner flange 11 designed with considerable wall thickness encounter sufficient resistance whereby the mantle part 9,15 is in the vicinity of the bottle opening stretched to such an extent and its thickness is thus reduced to such an extent that the closure stopper can be again removed from the bottle. The upper end of the bottle neck 16 thus also serves for pulling out the stopper from the bottle as counterbearing for a stretching of the mantle part 9,15

It is of particular advantage that for the pulling out of the stopper from the bottle no greater effort is required than that necessary for pressing the stopper into the bottle. This is due primarily to the fact that the mantle part 9,15 during the pulling out of the stopper is able with its part already pulled out of the bottle to reduce itself in diameter. With these selected dimensions of inner and outer flange 11, 10 the diameter of the shank 5 may amount to in excess of 50 percent of the diameter of the piston 4 without the danger that the sleeve part will separate from the piston 4.

Due to the relatively thick bottom 14 of the sleeve part 1 it will be brought about that when introducing the closure stopper into the bottle, substantially only the mantle part 9,15 is greatly deformed. Consequently the length of the shaft 5 may be short, about from 15–20mm.

The outer diameter of the mantle part 9,15 could in nondeformed condition also be shorter than the inner diameter of the bottle neck to be closed so that the bottle part is under load pulled onto the piston 4. Advantageously, the outer diameter thereof is selected somewhat greater than the inner diameter of the bottle necks, to approximately 21mm. Between mantle part 9,16 and piston 4 in non-deformed condition of the sleeve part 1, some play may be provided (FIG. 4). The length of the piston 4 approximately equals the corresponding length of the non-deformed sleeve part 1.

The mantle part 9, 15 may outside the bottle opening easily be withdrawn from the piston 4 so that a cleaning of the two stopper parts 1 and 2 is possible individually.

It is, of course, to be understood that the present invention is by no means limited to the specific showing in the drawing but also comprises any modifications within the scope of the appended claims.

What ! claim is:

1. A stopper for bottles, especially for closing uncorked wine and champagne bottles, which includes: an elastic deformable sleeve member having a mantle section and a closed bottom section and an open top section, said top section of said sleeve member comprising a radially outwardly extending flange for placement onto the neck end face of the bottle to be closed and also comprising a radially inwardly extending flange, and a handle member coaxially arranged with regard to said sleeve member and comprising a cap and an inner member including a rigid longitudinally extending cylindrical piston and a connecting rod rigidly connecting said piston to said cap, the outer diameter of said piston being slightly less than the inner diameter of the bottle neck portion to be closed by said stopper, and the wall thickness of said sleeve mantle section in non-deformed condition of said sleeve member being greater than the thickness of the annular gap between the outer periphery of said piston and the bottle neck section of the bottle to be closed by said stopper.

2. A stopper according to claim 1, in which said sleeve member consists of a tough elastic material adapted to withstand refrigerating temperatures.

3. A stopper according to claim 2, in which said sleeve member consists of tough elastic soft rubber.

4. A stopper according to claim 1, in which said sleeve member mantle section is designed as a relatively thin-walled hollow cylinder of uniform wall thickness having a smooth burr-free surface, the central region of said mantle section being provided with a plurality of annular ribs.

5.. A stopper according to claim 4, in which the ribs have a cross section with an arched outer confinement.

6. A stopper according to claim 1, in which said inner flange and said outer flange and said bottom section of said sleeve member have a greater wall thicknes than the mantle section of said sleeve member.

7. A stopper according to claim 1, in which said inner flange and said outer flange have the top side thereof arranged flush in one plane.

8. A stopper according to claim 7, in which said inner flange projects downwardly below said outer flange.

9. A stopper according to claim 1, in which said bottom section of said sleeve member and the lower end of said piston are arched outwardly in downward direction.

10. A stopper according to claim 1, in which the length of said piston is approximately equal to the length of the non-deformed sleeve member.

11. A stopper according to claim 1, in which said inner flange has a coaxial cylindrical opening through which said connecting rod extends, the said cylindrical opening having a diameter approximately equalling the outer diameter of said connecting rod and approximating half the diameter of said piston, and in which the outer flange has a diameter approximately equalling the outer diameter of the bottle neck to be closed.

12. A stopper according to claim 1, in which said handle member consists of a substantially rigid body the cap portion of which forms a bowl-shaped hood for surrounding the upper portion of the bottle neck when said stopper is introduced into the bottle to be closed.

13. A stopper according to claim 4, in which with the non-deformed sleeve member the outer diameter of that sleeve mantle section which is provided with said ribs is greater than the inner diameter of the bottle neck to be closed.

14. A stopper according to claim 13, in which said sleeve mantle surrounds said piston with slight play.

15. A stopper according to claim 1, in which that end face of the piston which has the connecting rod connected thereto has a downwardly conical depression.

* * * * *